US005870936A

United States Patent [19]

McGehee

[11] Patent Number: 5,870,936

[45] Date of Patent: Feb. 16, 1999

[54] EDGE TRIMMING AND BOARD RIPPING APPARATUS AND METHOD

[75] Inventor: Ronald W. McGehee, Ukiah, Calif.

[73] Assignee: McGehee Equipment Company, Ukiah, Calif.

[21] Appl. No.: 942,174

[22] Filed: Oct. 1, 1997

Related U.S. Application Data

[62] Division of Ser. No. 614,771, Mar. 7, 1996, Pat. No. 5,761,979.

[51] Int. Cl.[6] ..... B26D 1/00

[52] U.S. Cl. ..... 83/13; 83/34; 83/75.5; 83/76.6

[58] Field of Search ..... 83/170, 171, 495–499, 83/504, 508.2, 508.3, 663, 102.1, 425.3, 425.4, 13, 34, 52, 72, 74, 75.5, 76.6, 76.7, 76.8; 144/239, 237

[56] References Cited

U.S. PATENT DOCUMENTS

| | | | |
|---|---|---|---|
| 259,661 | 4/1882 | Bowker . | |
| 1,263,443 | 4/1918 | Lien . | |
| 2,637,395 | 5/1953 | Muller | 83/504 |
| 3,276,492 | 10/1966 | Kervefors . | |
| 3,285,302 | 11/1966 | Thrasher . | |
| 3,292,672 | 12/1966 | Cleereman | 83/508.3 |
| 3,472,296 | 10/1969 | Johnson . | |
| 3,489,189 | 1/1970 | Thrasher . | |
| 3,534,789 | 10/1970 | Morris | 83/508.3 |
| 3,566,934 | 3/1971 | Thrasher . | |
| 3,580,305 | 5/1971 | Wright | 83/508.3 |
| 3,645,304 | 2/1972 | Thrasher . | |
| 3,665,984 | 5/1972 | Ackerfeldt . | |
| 3,685,556 | 8/1972 | VanSickle . | |
| 3,692,074 | 9/1972 | Nilsson . | |

(List continued on next page.)

FOREIGN PATENT DOCUMENTS

| | | |
|---|---|---|
| 64070 | 6/1983 | Finland . |
| 3343953 A1 | 6/1984 | Germany . |
| 3720169 A1 | 4/1988 | Germany . |
| 49-7557 | 1/1974 | Japan . |
| 152325 | 6/1985 | Norway . |
| 895652 | 1/1982 | Russian Federation . |
| 306415 | 11/1968 | Sweden . |
| 398609 | 1/1978 | Sweden . |
| 422296 | 3/1982 | Sweden . |
| 436849 | 1/1985 | Sweden . |
| 33098 | 12/1908 | Switzerland . |

OTHER PUBLICATIONS

ARI Aktiebolag, *Curve Sawing Using ARI Technique,* Curve Sawing Machine product literature.

Forest Industries, *Curve Sawing: Adapting an Old Technique to a Modern Guided–Saw Scrag,* p. 24, Jun. 1988.

Laser–Technical Instruments, Inc., *Laser Blazer® Linemaker,* product literature.

Ukiah Machine and Welding, Inc., *Bottom Arbor Edgers & Gangs,* product literature.

Ukiah Machine and Welding, Inc., *Infeed and Outfeed Systems,* product literature.

Wood Machining Institute, *Wood Machining News,* vol. 5, No. 3, May/Jun. 1988.

*Primary Examiner*—M. Rachuba

*Attorney, Agent, or Firm*—Townsend and Townsend and Crew LLP

[57] ABSTRACT

An improved saw assembly (30) includes a rotatable arbor (74) on which two or more saw blades (75) are mounted. The driving interface (96, 98) between the saw blades and the arbor permits the axis of rotation of the saw blades to be collinear with the arbor axis (90) or skewed a few degrees (94) in either direction. A saw blade positioning assembly (72) includes pairs of guide arms (84) which engage the sides (88) of the saw blades to position each saw blade at the proper location along the arbor and at the proper skew angle. The guide arms are moved in unison so that the axial position and the skew angle of each of the saw blades can be changed in unison before and during sawing operations.

9 Claims, 17 Drawing Sheets

U.S. PATENT DOCUMENTS

| | | |
|---|---|---|
| 3,703,915 | 11/1972 | Pearson . |
| 3,736,968 | 6/1973 | Mason . |
| 3,968,822 | 7/1976 | Ottosson et al. . |
| 4,074,601 | 2/1978 | Warren et al. . |
| 4,077,448 | 3/1978 | Hasenwinkle et al. . |
| 4,127,044 | 11/1978 | Kenyon . |
| 4,144,782 | 3/1979 | Lindstrom . |
| 4,219,056 | 8/1980 | Lindström . |
| 4,239,072 | 12/1980 | Meriläinen . |
| 4,373,563 | 2/1983 | Kenyon . |
| 4,416,312 | 11/1983 | Östberg . |
| 4,419,914 | 12/1983 | Evans . |
| 4,440,203 | 4/1984 | Östberg . |
| 4,441,537 | 4/1984 | Vartiainen . |
| 4,449,557 | 5/1984 | Mäkelä . |
| 4,485,861 | 12/1984 | Nilsson et al. . |
| 4,548,247 | 10/1985 | Eklund . |
| 4,572,256 | 2/1986 | Rautio . |
| 4,580,086 | 4/1986 | Tokuno et al. . |
| 4,599,929 | 7/1986 | Dutina . |
| 4,633,924 | 1/1987 | Hasenwinkle et al. . |
| 4,653,560 | 3/1987 | Wislocker et al. . |
| 4,690,188 | 9/1987 | Hasenwinkle . |
| 4,691,751 | 9/1987 | Komulainen . |
| 4,715,254 | 12/1987 | DeGan . |
| 4,922,780 | 5/1990 | Hurdle, Jr. . |
| 4,930,387 | 6/1990 | Miettinen . |
| 4,960,023 | 10/1990 | Reuter et al. . |
| 4,961,359 | 10/1990 | Dunham . |
| 5,123,319 | 6/1992 | Reuter . |
| 5,551,327 | 9/1996 | Hamby et al. . |

EDGE TRIMMING AND BOARD RIPPING APPARATUS AND METHOD

This is a Division of U.S. Pat. application Ser. No. 08/614,771, filed Mar. 7, 1996, U.S. Pat. No. 5,761,979 the disclosure of which is incorporated by reference.

BACKGROUND OF THE INVENTION

Many trees do not grow straight so that the logs cut from the trees are swept or curved in shape. Special procedures and equipment must be used to maximize the board feet of lumber cut from these imperfect logs. FIGS. 1A and 1B illustrate two typical swept or curved logs 2, 3. FIG. 2 is an end view of log 2 showing how the swept or curved feature is typically in a single plane. To create lumber from log 2, side boards 4, illustrated in FIG. 3, are, in this typical example, cut from log 2 by making cuts along lines 6, 7 on either side of log 2 so that each side board 4 has parallel, cut surfaces 8, 9 and unfinished, uncut edges 10, 11. These cuts are made in a conventional manner. What is left of log 2 is called a center cant illustrated as center cant 12 in FIG. 4.

Center cant 12 has opposite, parallel, cut surfaces 14, 15 which correspond to surfaces 9 of boards 4 made at cutting lines 7. The end 16 of center cant 12 in FIG. 4 has a number of dashed cut lines 18 corresponding to where cant 12 will be rip sawn to create center cant lumber 20. See also FIG. 5. To maximize the board feet of lumber from center cant 12, cut lines basically parallel the edges 22 of center cant 12. While the center cant lumber 20 will originally have the same curved or swept shape as center cant 12, most, if not all, of this curve can be removed during drying operations. Side boards 4 are cut differently than center cant 12 to maximize the amount of side board lumber 24 as suggested in FIG. 6. Using conventional computer-controlled edger optimizing systems, the number, size and position of center cant lumber 20 and side board lumber 24 are determined automatically using appropriate computer programs based upon profile information of the side board 4 or center cant 12 scanned into the computer.

For example, U.S. Pat. No. 4,239,072 discloses a method and apparatus for edge trimming a side board. A number of overhead pressure rolls engage the side board as the side board passes along a chain conveyor. The side board is centered by sets of centering rolls. A number of scanning gates are positioned above the conveyor to provide a computer with appropriate information on the profile of the side board. The edging assembly includes a pair of adjustable cutting heads designed to chip the unwanted edges from the side board. The cutting heads are slewed in a direction perpendicular to the direction of movement of the board by hydraulic cylinders so that one or more pieces of side board lumber can be cut from a single side board.

U.S. Pat. No. 4,449,557, assigned to the same assignee as U.S. Pat. No. 4,239,072, uses substantially the same system for delivering partially cut logs to an edging assembly as the '072 patent. However, instead of using angled edge chippers, as in the '072 patent, the '557 patent uses sawing disks or saw blades to make the edge cuts. The entire edger system moves as a unit so that the sawing disks can skew, that is change the angle between the axis of rotation of the sawing disks and the axis of rotation of the arbor on which the saw blades are mounted, and can slew, that is move laterally along a line generally parallel to the axis of rotation of the arbor.

Conventional edger optimizer systems measure the boards transversely and then position the board onto a feeding mechanism and move the board longitudinally into the edger. This conventional method requires a considerable amount of expensive scanning, positioning and transporting equipment to carry out the process. Conventional systems also commonly create cumulative scanning, positioning and transport errors that make the systems somewhat less than optimal. With regard to the '557 patent, complex board centering mechanisms, multiple scanner heads, complex and high maintenance feeding and tracking devices, and complex high inertia edger rotation devices are all characteristic of the system described in the patent.

SUMMARY OF THE INVENTION

The present invention is directed to an edge trimming and board ripping apparatus and method which provides a greatly simplified approach to optimally edging and ripping boards.

The edge trimming and board ripping apparatus includes an improved saw assembly used as a part of a sawing apparatus. The sawing apparatus, in the preferred embodiment, includes an in-feed assembly which delivers side boards or center cants one at a time to a scanning assembly. The side boards and center cants both have two parallel cut surfaces and are referred to generically as partially cut logs or just cut logs. The scanning assembly preferably includes a scanner adjacent to a scanning conveyor. The scanner scans the cut log and provides a profile of the log to a computer which controls the operation of the improved saw assembly. The saw assembly is preferably part of a cutting assembly. The cutting assembly includes a press roll assembly which maintains the cut log in the same orientation, passing through the saw assembly, as the cut log had when it passed the scanner.

The saw assembly includes a rotatable arbor on which two or more saw blades are mounted. The driving interface between the saw blades and the arbor permits the axis of rotation of the saw blades to be collinear with the arbor axis or skewed a few degrees in either direction.

The saw assembly also includes a saw blade positioning assembly which engages and positions each of the saw blades. The saw blade positioning assembly includes a saw blade positioner for each saw blade.

Each saw blade positioner preferably includes a positioner body to which a pair of guide arms are pivotally mounted. The guide arms preferably have saw blade engagement pads which engage the annular side surfaces of the saw blades to keep each saw blade at the proper position along the axis of the arbor and at the proper skew angle. The skew angle is the angle between the axis of rotation of the saw blade and the axis of rotation of the arbor. The guide arms can be pivoted in unison so that the skew angle of each of the saw blades can be changed in unison by the same amount.

Each of the saw blade positioners can be moved axially along the arbor axis to desired arbor axis locations according to the width of the cuts to be made on the partially cut log. The saw blade positioner can also be moved in unison along the arbor according to the direction of the cut to be made in the partially cut log. Changing the axial position of the saw blades along the arbor is called slewing and is preferably accomplished using separate slewing actuators, one for each saw blade positioner.

With the present invention, side board lumber can be cut from side boards by edge trimming the side board and, optionally, rip sawing the side board to create one or more pieces of side board lumber. Also, center cants can be simultaneously edge trimmed and rip sawed to create center cant lumber from the center cant using the saw assembly made according to the invention.

One of the primary advantages of the invention is its simplicity. The partially cut board need not be centered on the scanning conveyor or the feed chain of the press roll assembly but rather simply placed somewhere on the scanning conveyor. Therefore, no centering rolls, as are used with conventional edger systems, are needed. Also, the present invention is designed to be used with only a single scanner, as opposed to the multiple scanners used with conventional systems, thus reducing cost. In addition, the present invention is adapted for use for both edge trimming and board ripping of both side boards and center cants making it very flexible.

An additional advantage is that the slewing assembly is used to both initially position the saw blades at the desired locations along the arbor axis as well as slew, in unison, the saw blades while sawing the log. Also, the same structure used to position the saw blades along the arbor axis (that is the pair of guide arms of the slewing assembly pivotally mounted to the positioner body in the preferred embodiment) is used to keep the saw blades at the proper skewing angle. Thus, of the actual sawing components (motor, arbor, saw blades, support frame), the only components which must move during sawing operations are the saw blades; the arbor, except for rotating about its arbor axis, remains stationary as well as the electric motor which drives the arbor and the support frame which supports the motor and arbor. The complicated slewing and skewing schemes used with conventional edger systems are eliminated.

Other features and advantages of the invention will appear from the following description in which the preferred embodiment has been set forth in detail in conjunction with the accompanying drawings.

DESCRIPTION OF THE PREFERRED EMBODIMENT

Figure 7:
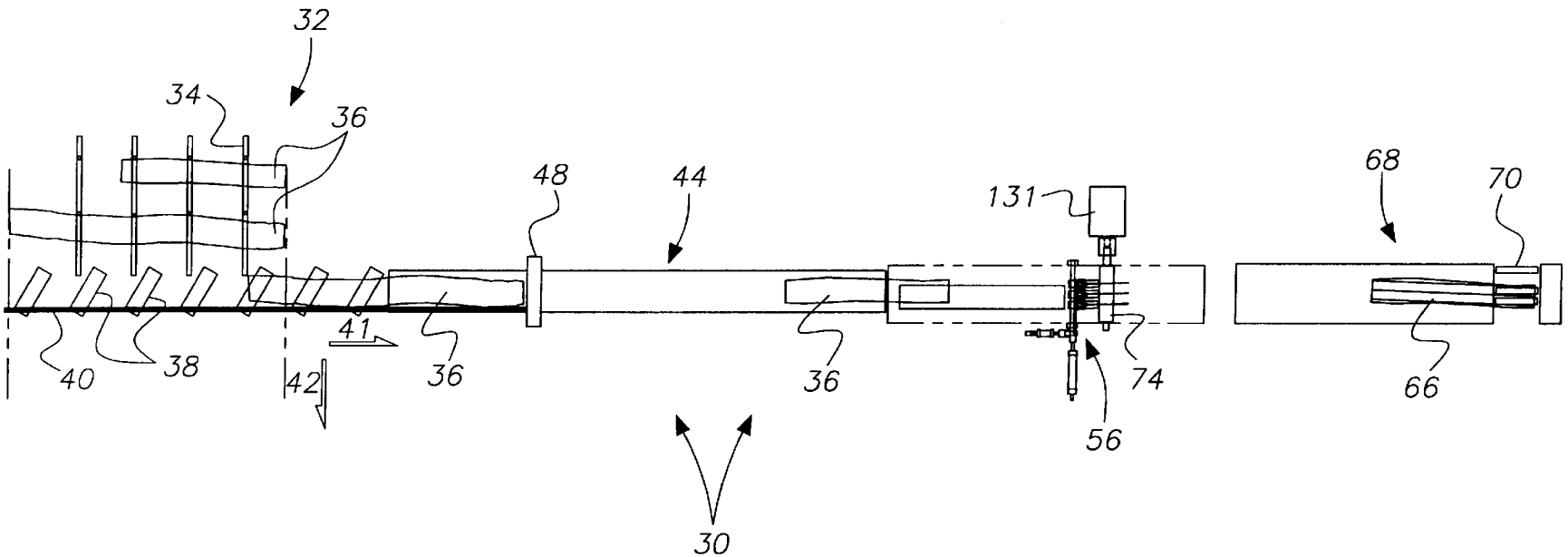
FIG. 7 is a simplified top plan view of a sawing apparatus made according to the invention.
Figure 8:
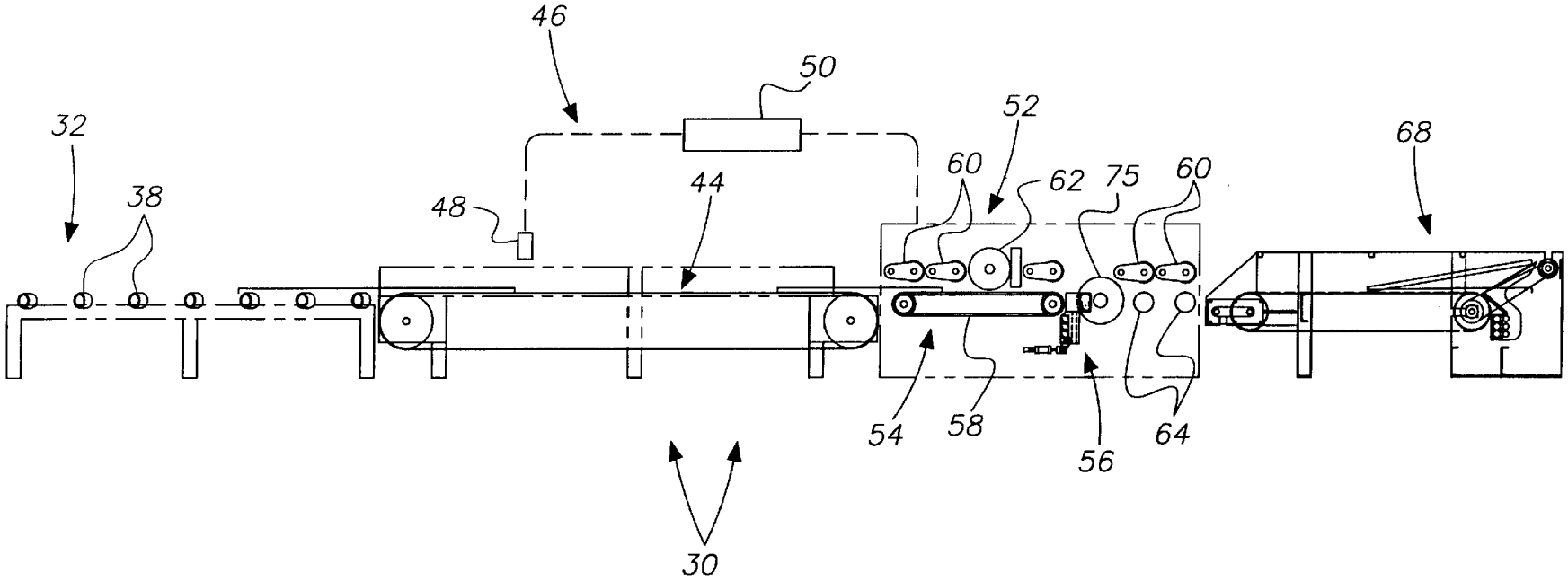
FIG. 8 is a simplified side view of the apparatus of FIG. 7.

FIGS. 7 and 8 illustrate an edge trimming and board ripping apparatus 30, also called a sawing apparatus 30, made according to the invention. Sawing apparatus 30 includes an in-feed assembly 32 having a conventional in-feed lug chain 34 which delivers partially cut logs 36 to a set of canted drive rolls 38. In-feed assembly 32 also includes a fence 40 aligned generally with the far ends of drive rolls 38. Drive rolls 38 are rotated to direct partially cut logs 36 in a longitudinal or forward direction 41 and also in a lateral or in-feed direction 42 so that partially cut log 36 is pressing against fence 40 as the log exits in-feed assembly 32 and onto a scanning conveyor 44. Partially cut logs 36 are therefore positioned somewhere on the upper reach of scanning conveyor 44 but not centered on anything in particular.

Scanning conveyor 44 is part of a scanning assembly 46 which includes both scanning conveyor 44 and a scanner 48. Scanner 48 is of conventional design and is used to determine the profile of partially cut log 36 as it passes beneath scanner 48. This information is provided to a controller 50 which controls the operation of a cutting assembly 52 located downstream of scanning conveyor 44.

Cutting assembly 52 includes a generally conventional press roll assembly 54 and a saw assembly 56 made according to the invention. Press roll assembly 54 includes a driven feed chain 58 having three pivotal press rolls 60 positioned above the feed chain to ensure partially cut log 36 maintains the same orientation it had passing under scanner 48 when the partially cut log is delivered to saw assembly 56. Press roll assembly 54 also includes a drum-style reman head 62. Reman head 62 is a cutter head that can shift up and down to size the wood to the desired thickness. Press roll assembly 54 also includes a pair of driven exit rolls 64 which support the sawn lumber 66 exiting saw assembly 56 and propel the sawn lumber towards a discharge assembly 68. Two more driven press rolls 60 overlie exit rolls 64 and ensure partially cut log 36 does not shift while passing through saw assembly 56. Sawn lumber 66 passes to discharge assembly 68 having a paddle picker outfeed 70 to separate sawn lumber 66 from waste edge trimmings.

Figure 9:
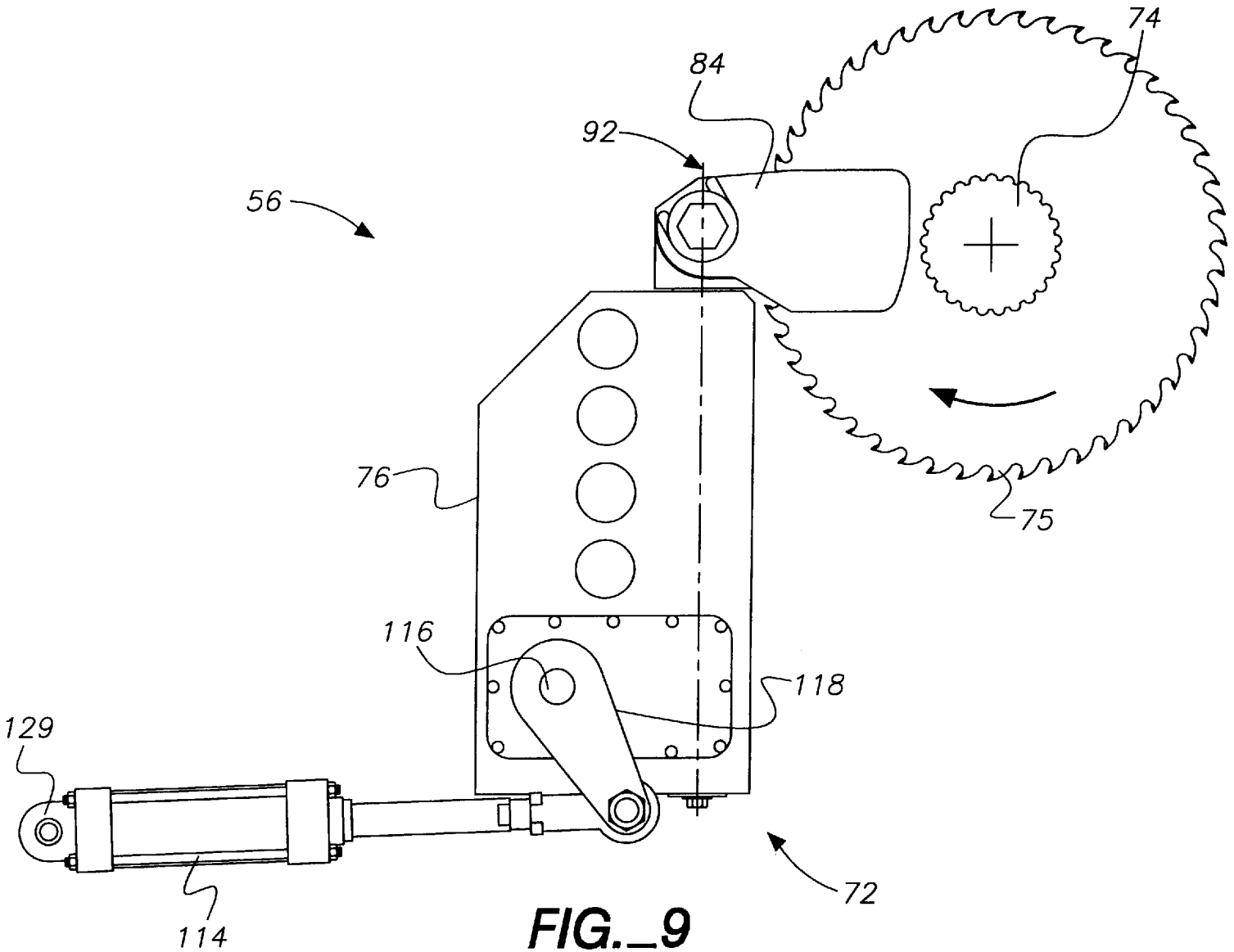
FIG. 9 is an enlarged side view of the saw assembly of FIG. 8.
Figure 10:
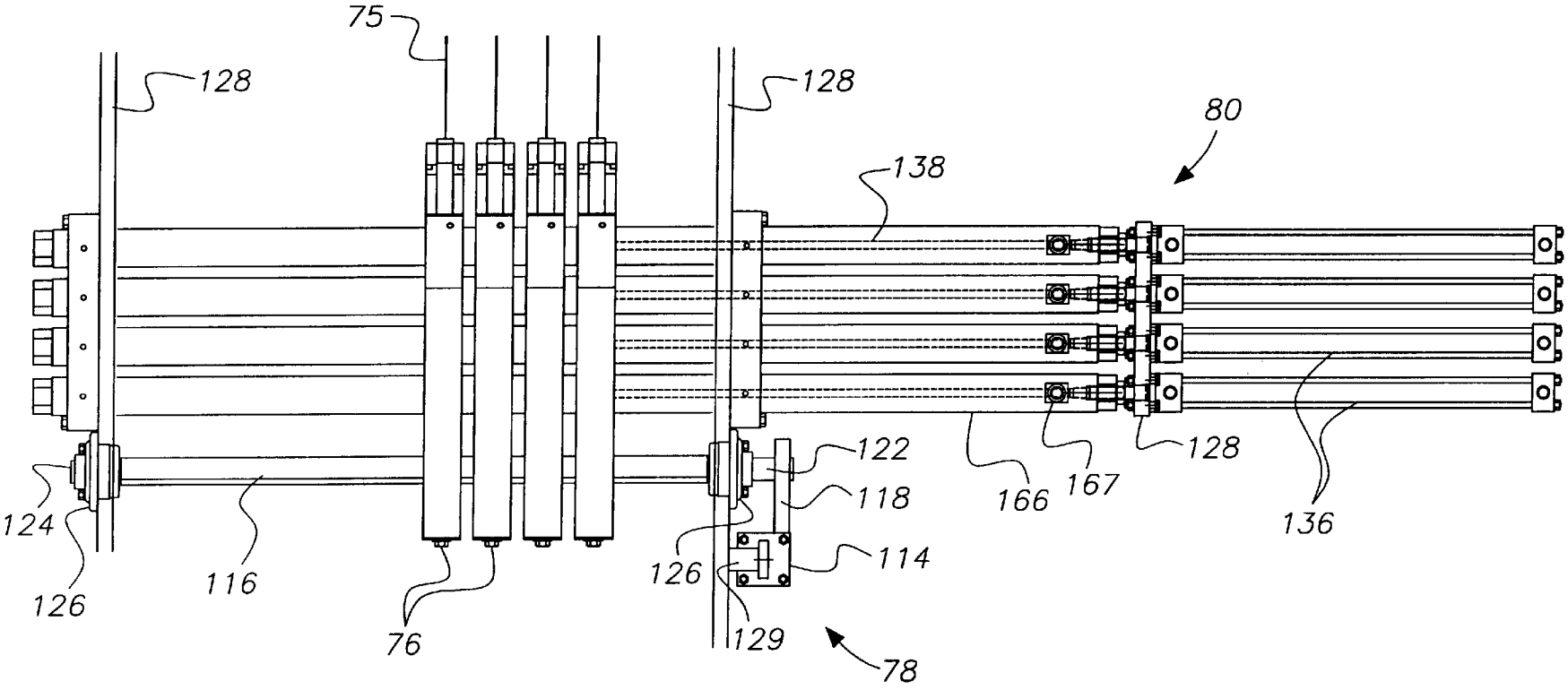
FIGS. 10 and 11 are end and top views of the saw assembly of FIG. 9 (without the arbor but showing portions of a support frame) showing a set of four saw blade positioner assemblies and associated saw blades at a first set of locations along the arbors and at a zero cant in FIG. 10 and at a 2° cant in FIG. 11, and also illustrating, in dashed lines, the positions of a set of three saw blade positioning assemblies and associated saw blades at a different set of locations along the arbor.
Figure 11:
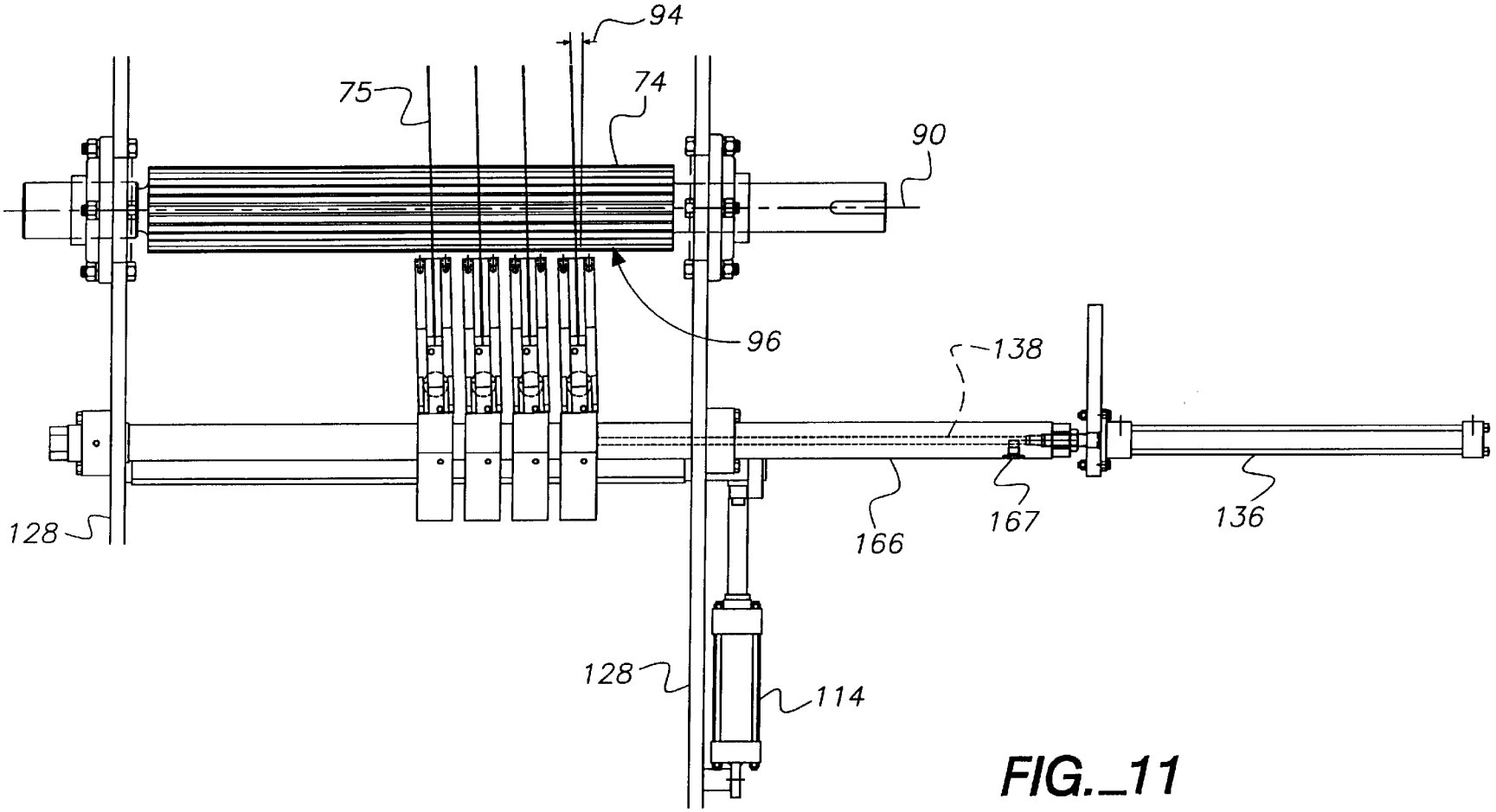
Figure 12:
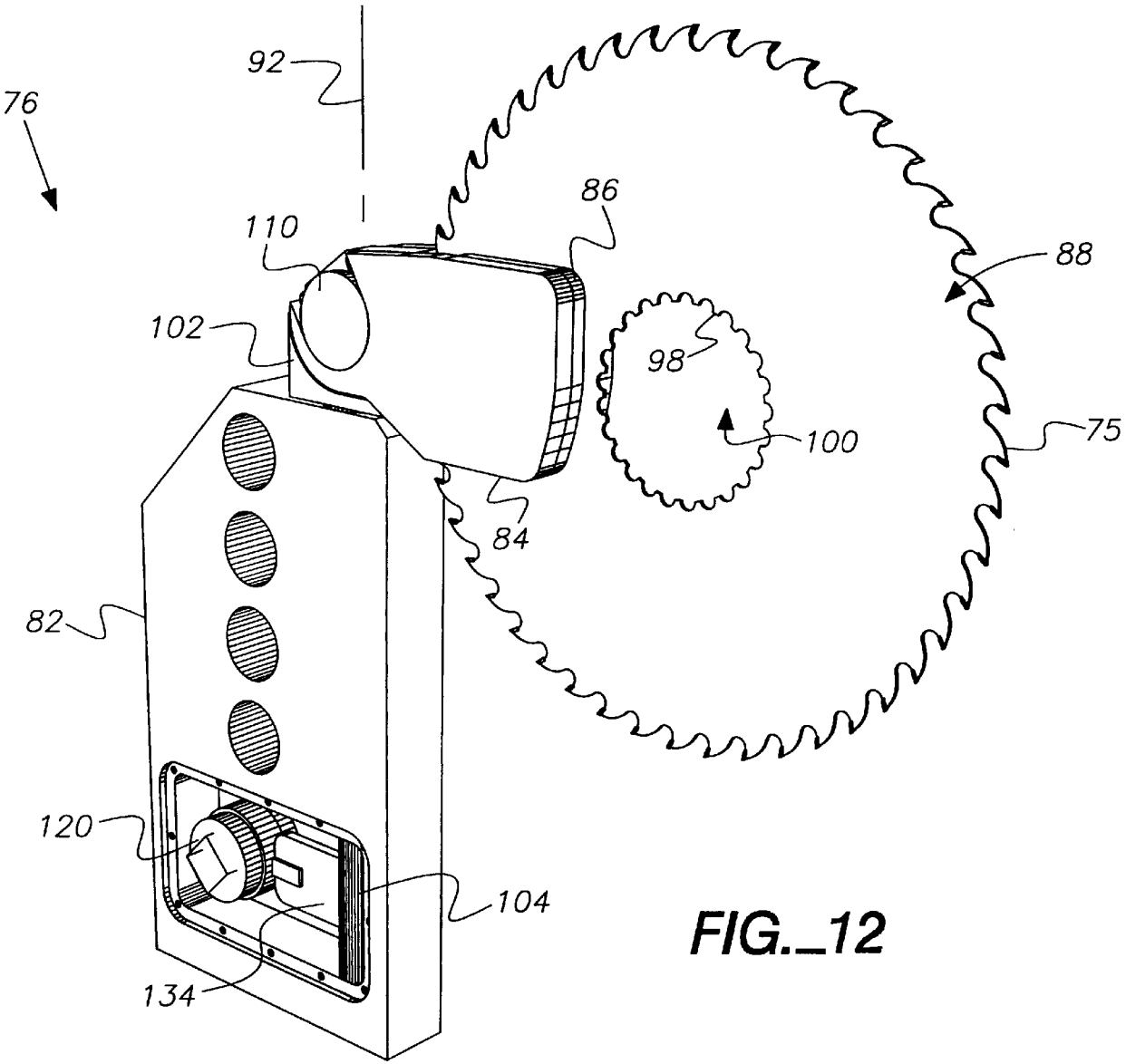
FIG. 12 is an enlarged isometric view of the saw blade positioner of FIG. 9 together with a saw blade.

FIGS. 9—11 illustrate saw assembly 56 separate from the remainder of cutting assembly 52. Saw assembly 56 includes a saw blade positioner assembly 72, a rotatable arbor 74 and a set of saw blades 75. Saw blade positioning assembly 74 includes two or more saw blade positioners 76 (four in the preferred embodiment) plus a skewing assembly 78 and a slewing assembly 80 (shown best in FIG. 10).

FIGS. 12—16 illustrate saw blade positioner 76, conjunction with a saw blade 75. Saw blade positioner 76 includes a positioner body 82 which supports a pair of guide arms 84. Guide arms 84 each have a low friction pad 86, typically made of babbit, positioned to engage the annular side surfaces 88 of saw blade 75. Guide arms 84 locate each saw blade 75 along the arbor axis 90. Also, since guide arms 84 are pivotal about a generally vertical pivot axis 92 passing through positioner body 82, guide arms 84 also determine whether the axis of rotation of each saw blade 75 is collinear with arbor axis 90 or if it is offset or skewed by a skewing angle, such as from 0° to ±5°, ±2° being a typical maximum skew angle. A 2° skewing angle 94 is illustrated in FIG. 11.

The outer, drive surface 96 of arbor 74 is scalloped as is the inner surface 98 of saw blade 75 defining eye 100. The diametral dimension of surface 98 is greater than the corresponding diametral dimension of surface 96 by an amount sufficiently small to permit a good driving interface between surfaces 96, 98 but sufficiently large to permit the desired range of skewing angles to be used. Conventional saws have an eye which is about 0.008 to 0.010 inch (0.20 to 0.25 mm) larger in diameter than the arbors to which they are mounted, assuming a nominal arbor diameter of about 6 inches (15 cm). It is expected that increasing this difference in diametral dimensions to about 0.020 inch (0.51 mm) should prove satisfactory. Also, the inner surface of conventional saw blade are square cut since they are typically intended to have a zero skew angle. However, with the present invention, inner surface 98 may be rounded to eliminate an edge or corner of surface 98 from engaging drive surface 96 of arbor 74.

Figure 13:
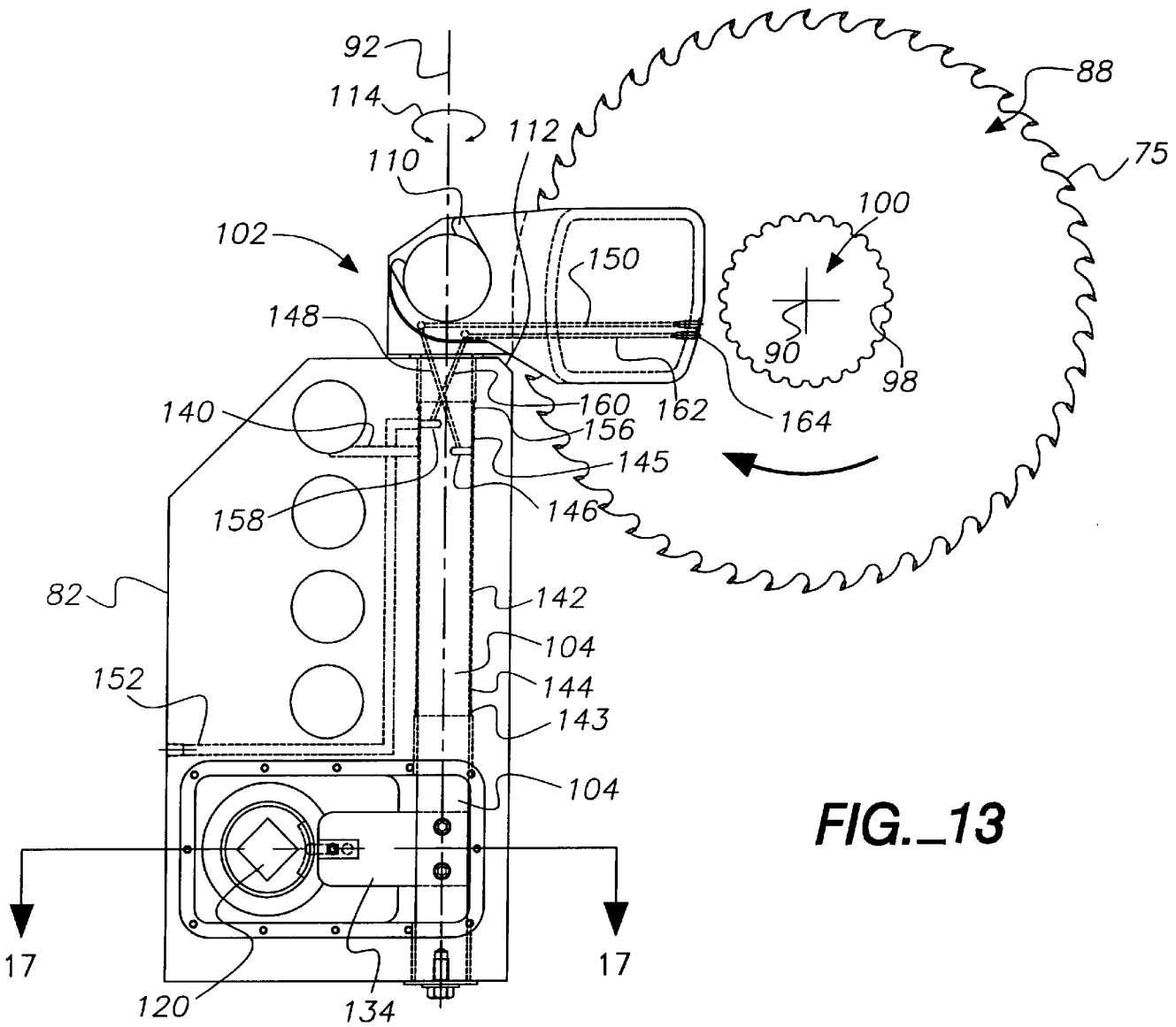
FIGS. 13, 14 and 15 are side, top and end views of the saw blade positioner of FIG. 12.
Figure 14:
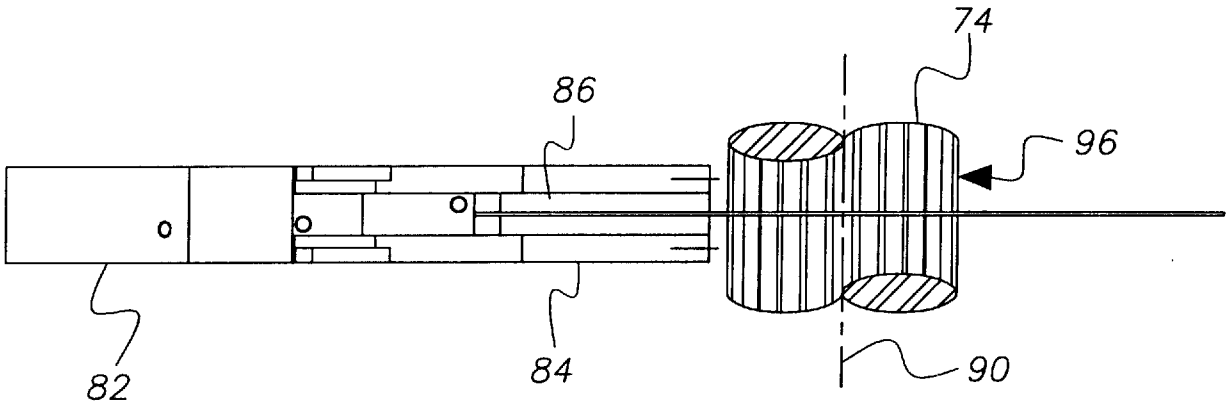
Figure 15:
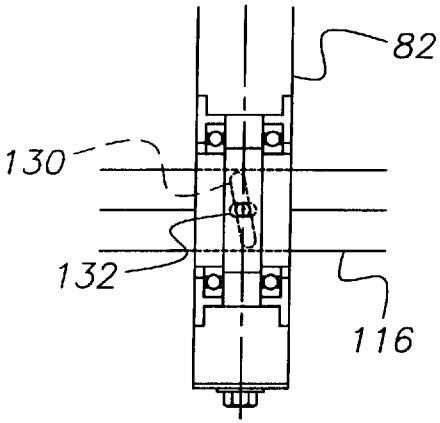
Figure 16:
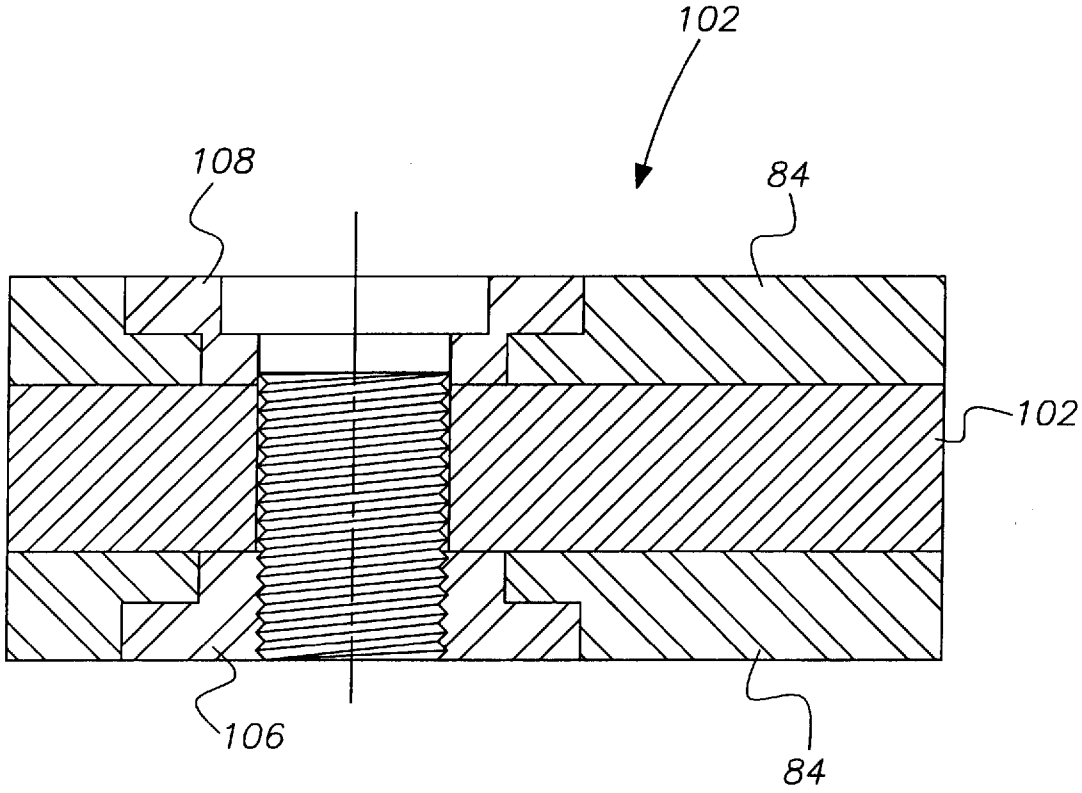
FIG. 16 is a somewhat simplified cross-sectional view taken along line 16—16 in FIG. 12.

Guide arms 84 are supported by positioner body 82 through a coupler 102 at the upper end of a pivot shaft 104. Coupler 102 includes a pair of spools 106, 108 which engage U-shaped ledges 110 formed at the inner ends of guide arms 84. In their normal operating positions, such as shown in FIG. 13, guide arms 84 rest against a chamfered corner 112 of coupler 102 and are secured in place by tightening spools 106, 108. Guide arms 84 can be swung out of the way, that is pivoted in the direction of arrow 114 of FIG. 13, by loosening spools 106, 108 and pivoting the guide arms about 90° to 120°. This permits free access to both guide arms 84, such as to replace pads 86, or saw blades 75.

Figure 17:
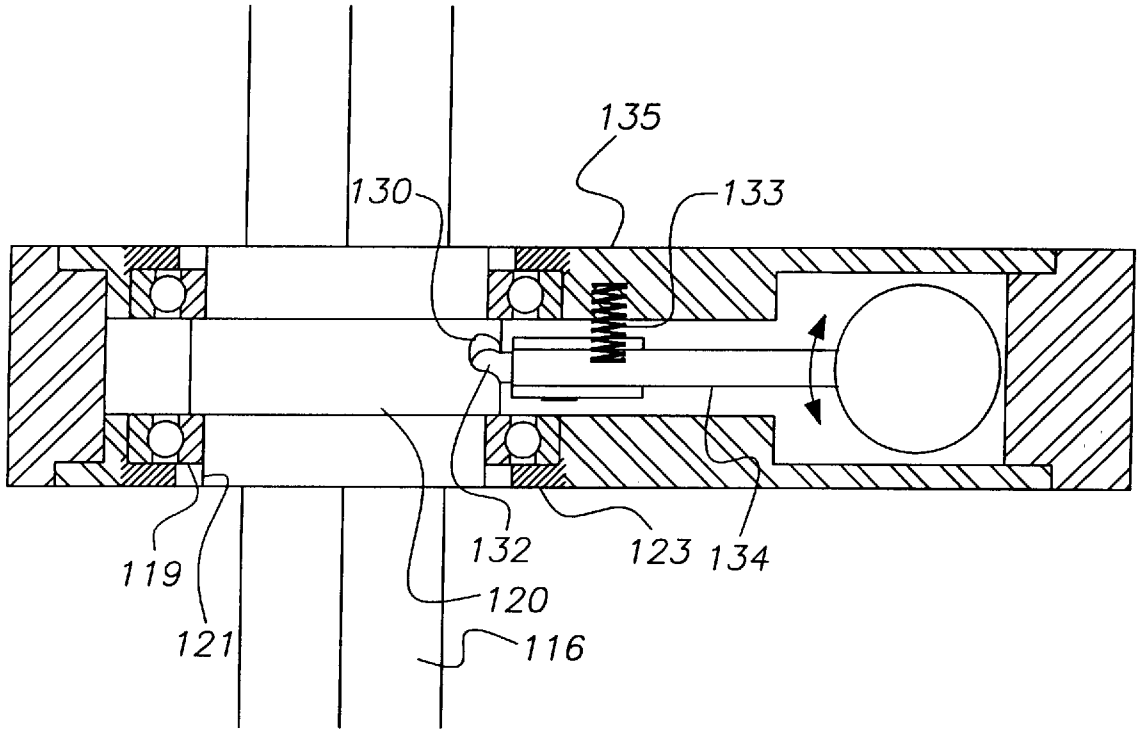
FIG. 17 is an enlarged cross-sectional view taken along line 17—17 in FIG. 13.

Pivot shaft 104 is rotated about its vertical pivot axis 92 by the actuation of a skewing cylinder 114. Skewing cylinder 114 is coupled to a skewing drive shaft 116 through a crank arm 118. Drive shaft 116 has a square cross-sectional shape and passes through a complementary opening in a rotary cam 120. Rotary cam 120 is secured within body 82 by the inner races 119 of a pair of bearings 121. See FIG. 17. Bearings 121 are secured in place by a pair of alignment nuts 123 threadably secured to body 82.

The ends 122, 124 of skewing drive shaft 116 are supported by bearings 126 mounted to the frame 128 of cutting assembly 52. Frame 128 also supports one end 129 of skewing cylinder 114, the ends of arbor 74 and an electric motor 131 (see FIG. 7) which drives arbor 74.

Rotary cam 120 has an angled slot 130 around a part of its periphery within which a pin 132 extending from a paddle 134 engages. Paddle 134 is a rigid extension of pivot shaft 104 so that as rotary cam 120 is rotated through the rotation of skewing drive shaft 116, pin 132 passes along slot 130 and in doing so pivots about axis 92. Thus, paddle 134 and pivot shaft 104 both pivot together about pivot shaft 92 according to the rotational motion of skewing drive shaft 116. A spring 133, captured between a set screw 135 and paddle 134, keeps pin 132 pressing against one side of slot 130. This keeps pin 132 from moving laterally within the slot thus keeping the skewing angle of saw blade 74 stable during use. Since the same skewing drive shaft 116 engages each saw blade positioner 76, each saw blade 75 is skewed in unison by its respective guide arms 84 as the guide arms rotate about axis 92.

Slewing assembly 80 is used to position each saw blade positioner 76 and saw blade 75 therewith along arbor axis 90. Slewing assembly 80 includes a shift shaft 166 and an axial locating and slewing linear actuator 136 for each saw blade positioner 76. Typically the spacing between each saw blade 75 is determined prior to partially cut log 36 being cut by saw blades 75. However, during the sawing process, saw blades 75 can be slewed, that is moved, along surface 96 of arbor 74 parallel to arbor axis 90 by the simultaneous actuation of each slewing actuator 136. As can be seen in FIGS. 10 and 11, actuators 136 are supported along their lengths by frame 128.

To reduce friction and thus minimize wear and reduce heat buildup between pads 86 and surfaces 88 of saw blades 75, a liquid, such as water, is applied to surface 88. Each shift shaft 166 is coupled to a supply of lubricating liquid through a liquid port 167 and has a channel 138 (see FIGS. 10 and 11) along its length fluidly coupled to a corresponding passageway 140 (see FIG. 13) within the positioner body to which it is secured. Passageway 140 connects passageway 138 to an annular gap 142 formed between the outside surface of pivot shaft 104 and the generally cylindrical bore 144 formed in positioner body 82. This permits fluid flow through passageway 140, into annular gap 142 between O-rings 143, 145 and into a radial bore 146 formed in pivot shaft 104. Radial bore 146 is coupled to a connecting bore 148 which extends up into coupler 102. Connecting bore 148 is coupled to a final bore 150 formed in each guide arm 84. Each final bore 150 opens inwardly towards surface 88 to permit the liquid to be applied to surfaces 88, especially in the vicinity of pads 86.

In addition to cooling and providing some lubrication between pad 86 and surface 88, it is desired to lubricate the interface between inner surface 98 of saw blade 75 and outer drive surface 96 of arbor 74. This is achieved by connecting a lubricating bore 152 formed in each positioning body 82 with a source of lubricant, typically some sort of oil. Lubricant passes along lubrication bore 152 and enters annular gap 142 at a position between O-ring 145 and an O-ring 156. Lubricant is directed from passageway 152 into gap 142 and then into a radial passageway 158 in pivot shaft 104 and an upwardly extending passageway 160. Passageway 160, like passageway 148, connects to a final bore 162 formed in each guide arm 84. The outer end 164 of each final bore 162 is directed at arbor 74 thus providing a fine, controlled spray of lubricant to the arbor at its interface with inner surface 98 of saw blade 75.

In use, partially cut logs 36, which can be side boards 4 or center cants 12, are directed onto drive rolls 38 which move each log 36 in direction 41 towards scanning conveyor 44 and in direction 42 against fence 40. Once log 36 begins to pass under scanner 48, it has obtained a stable position on scanning conveyor 44. The profile for log 36 is provided to controller 50 which computes the optimal cutting scheme for the side board or center cant. Press roll assembly 54 ensures partially cut log 36 remains in the same position as it was when it passed under scanner 48 as the log is cut by saw assembly 56. Slewing assembly 80 initially locates the desired number of saw blades 75 at their initial positions for the start of the cutting operation on the upcoming log 36. This initial location includes both the location along arbor 74 and the spacing between each saw blade 75, both controlled by slewing actuators 136. Also, the initial skewing angle for each saw blade 75 is set by the actuation of skewing cylinder 114. As partially cut log 36 passes through saw blades 75, and assuming log 36 is a bent or swept log which requires specialized cutting, slewing assembly 80 and skewing assembly 78 will be actuated as needed.

Figure 6:
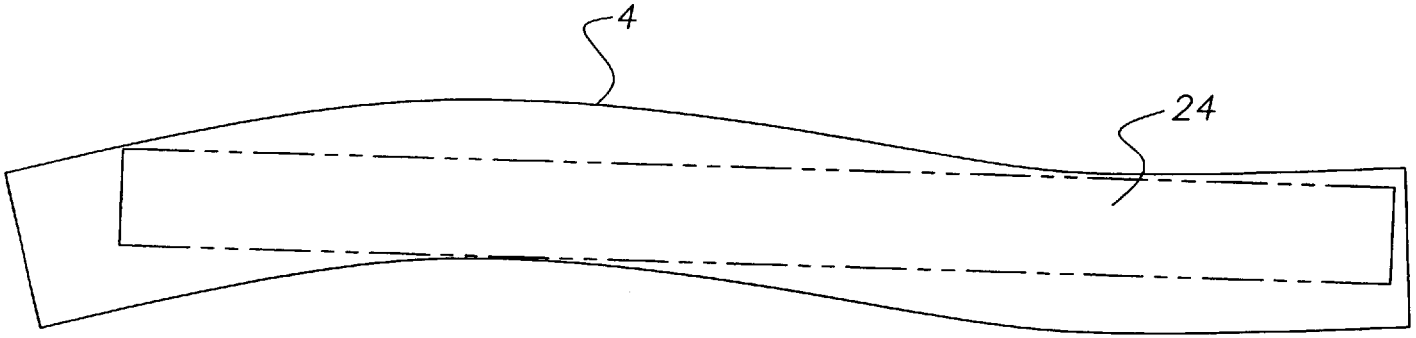
FIG. 6 is a simplified top plan of the side board of FIG. 3 illustrating the outlines of side board lumber to be cut from the side board of FIG. 3.

For the example of FIG. 6, only two saw blades 75 are used and set to an initial separation according to the width of side board lumber 24. After the initial skewing angle is determined and set by skewing assembly 78, the skewing angle does not change for each individual piece of side board lumber 24. Rather, the cut is made by the constant slewing of all the saw blades 75 along arbor 74 using slew assembly 80.

Figure 1A:
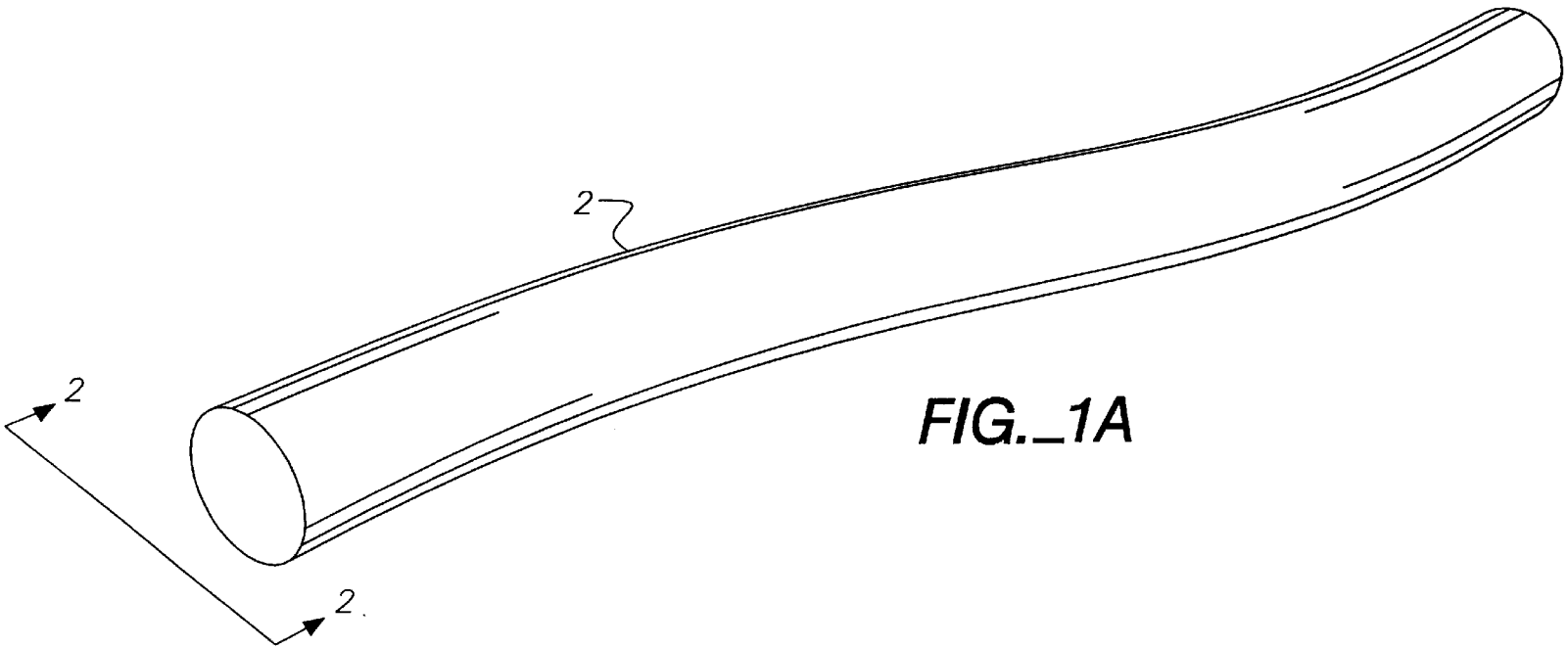
FIGS. 1A and 1B are overall views showing two different types of curved or swept logs.
Figure 1B:
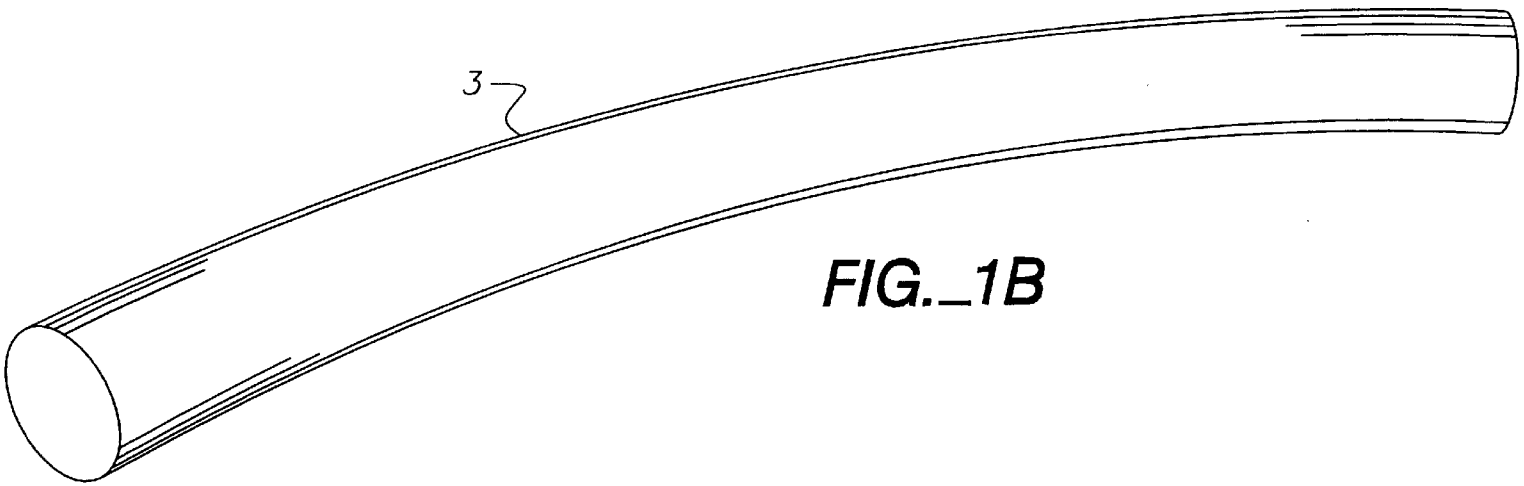
Figure 2:
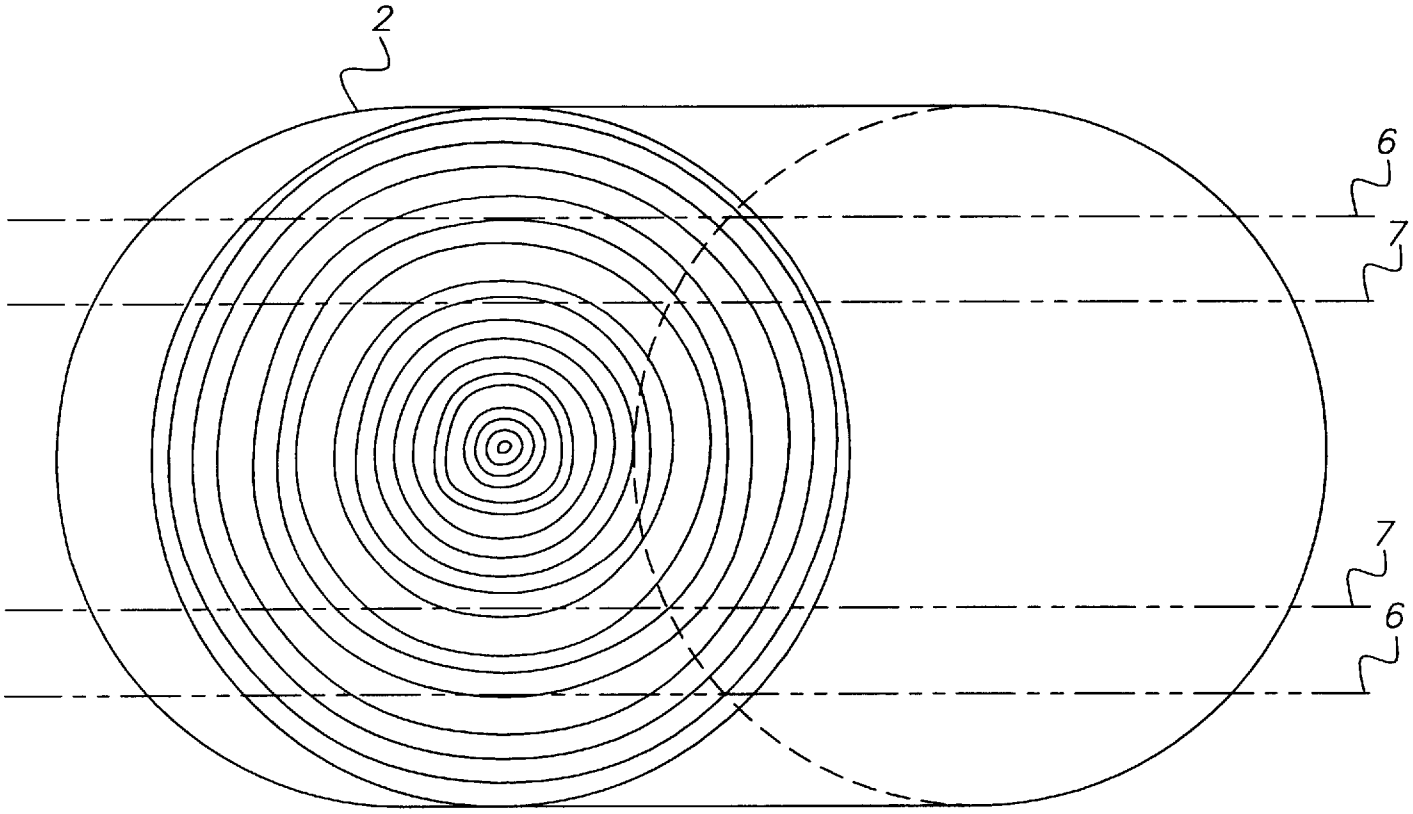
FIG. 2 is an end view of the log of FIG. 1A taken along line 2—2.
Figure 3:
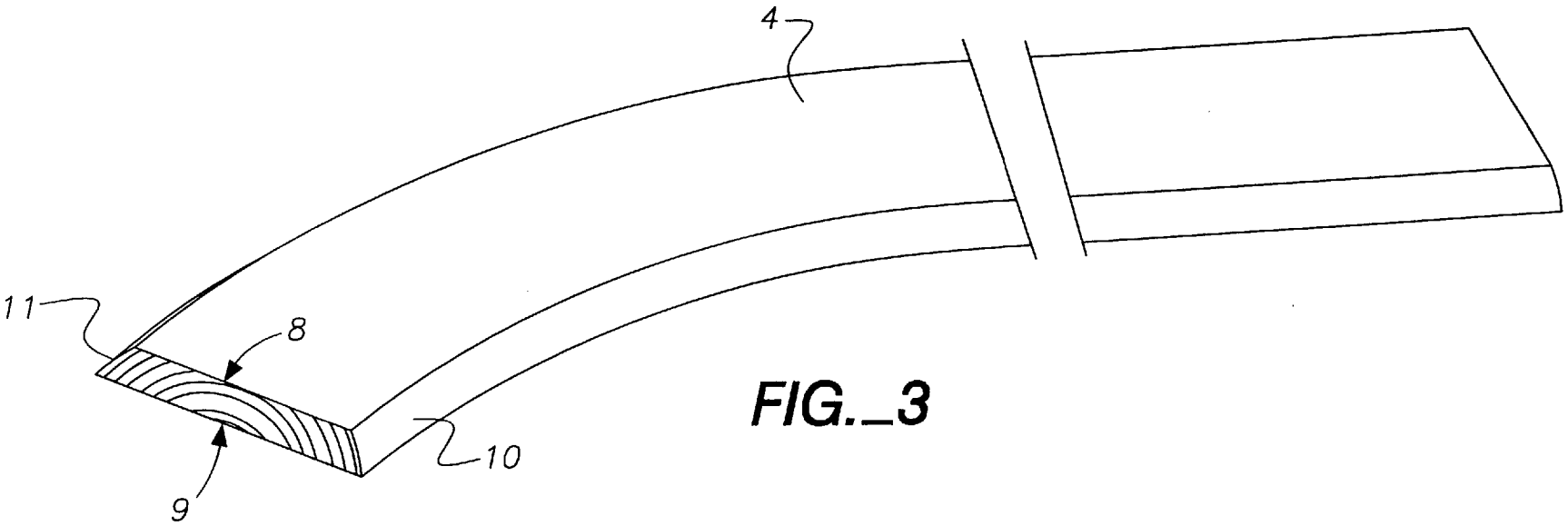
FIG. 3 is an enlarged view showing a side board cut from the log of FIG. 2.
Figure 4:
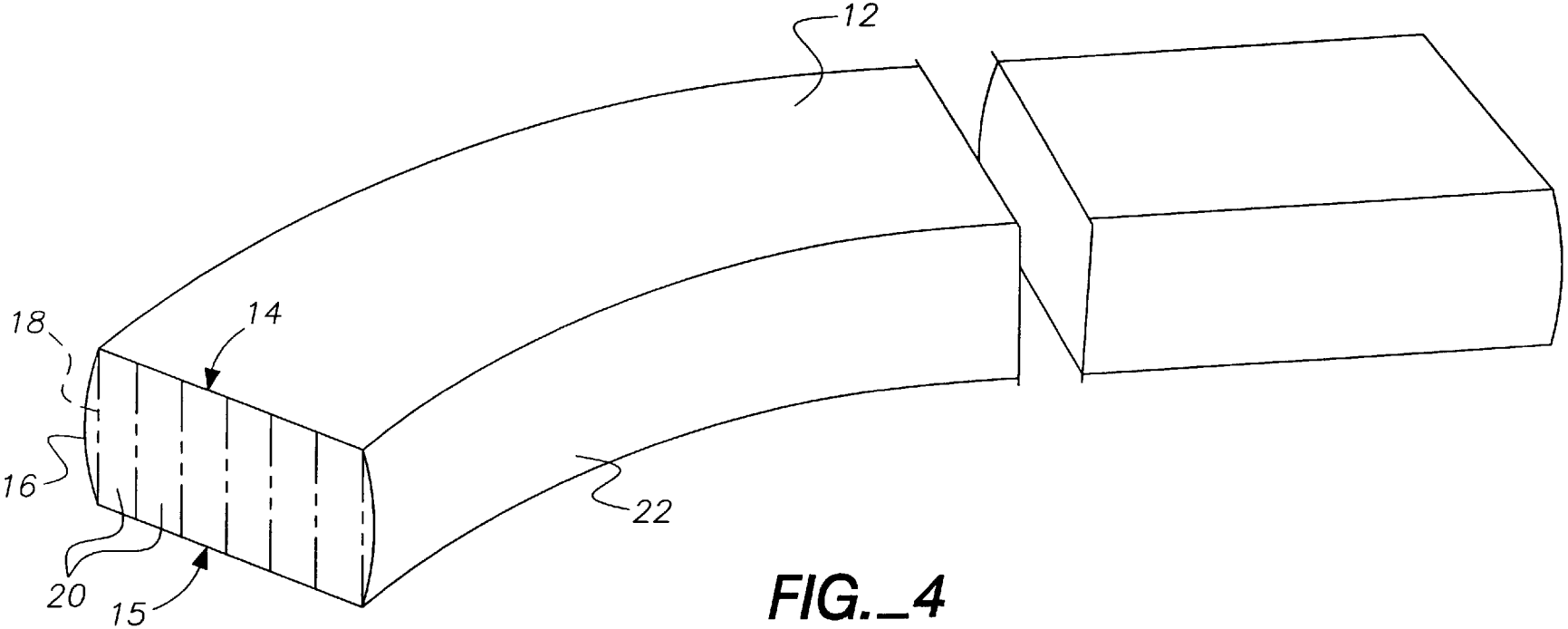
FIG. 4 is an enlarged view showing a center cant cut from the log of FIG. 2.
Figure 5:
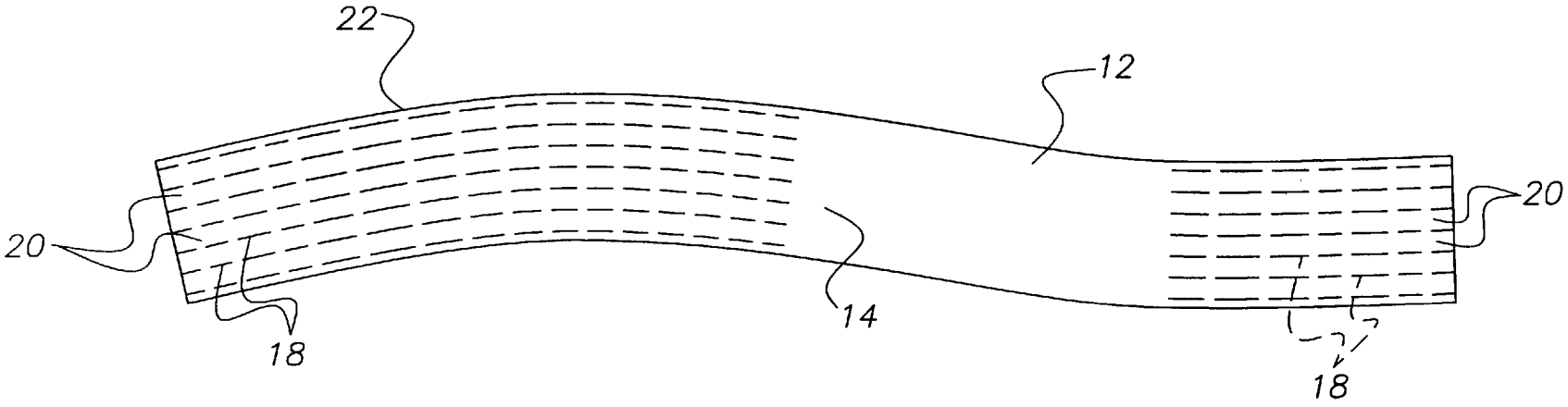
FIG. 5 is a simplified top plan view of the center cant of FIG. 4 illustrating dashed cut lines and the resulting center cant lumber to be cut from the center cant.

In contrast to the edging process used to create side board lumber 24, both edging and ripping is used to create the multiple pieces of center cant lumber 20 as suggested in FIG. 5. After the initial positioning and spacing of saw blades 75 along arbor 74 using slewing actuators 136 and the setting of the initial skewing angle of saw blades 75 using skewing assembly 78, both slewing assembly 80 and skewing assembly 78 are used during the cutting operation to make the cuts indicated by cut lines 18. The sawn lumber 66, be it center cant lumber 20 or side board lumber 24, is then directed to discharge assembly 68.

Modification and variation can be made to the disclosed embodiment without departing from the subject of the invention as defined in the following claims. For example, the proportions and numbers of center cant 12, center cant lumber 20, side boards 4, and side board lumber 24 illustrated in FIGS. 2–6 are simply one example for one particular log 2; some logs may produce no side board lumber. Arbor 74 may have an outer drive surface 96 which is other than scalloped, such as octagonal or oval. While surfaces 96, 98 are preferably generally complementary surfaces, they are not necessarily truly complementary.

What is claimed is:

1. A method for sawing lumber comprising the following steps:

scanning a log element to determine a cutting pattern;

directing the log element into and through a saw assembly saw blades mounted on and rotated by a rotating arbor, the saw blades each having a saw blade axis and the arbor having an arbor axis;

adjusting, in unison, the skew angle of the saw blade axis of each of the saw blades relative to the arbor axis over a range of skew angles, so said saw blade axes are offset from the arbor axis by a skew angle from 0° to at least one chosen skew angle;

positioning, in unison, each of the saw blades along the arbor; and said adjusting and positioning steps capable of being carried out while said saw blades are rotated by said arbor and cutting said log according to the cutting pattern determined by said scanning step.

2. The method according to claim 1 wherein said scanning step is carried out using a single profile scanner on a side board as the log element.

3. The method according to claim 1 wherein said scanning step is carried out on a center cant as the log element.

4. The method according to claim 1 wherein said directing step is carried out using a saw assembly having at least two said saw blades.

5. The method according to claim 1 further comprising the step of separating said saw blades by a chosen axial separation prior to the directing step.

6. The method according to claim 1 wherein said skew angle adjusting step takes place prior go the directing step.

7. The method according to claim 6 wherein said scanning step is carried out on a side board as the log element to create side board lumber.

8. The method according to claim 1 wherein the skew angle adjusting step and the positioning step take place as the log element is directed through the saw assembly.

9. The method according to claim 8 wherein said scanning step is carried out on a center cant as the log element to create center cant lumber.

* * * * *